US010851964B2

(12) United States Patent
Nakaya

(10) Patent No.: US 10,851,964 B2
(45) Date of Patent: Dec. 1, 2020

(54) LIGHTING FIXTURE FOR VEHICLE

(71) Applicant: MAZDA MOTOR CORPORATION, Hiroshima (JP)

(72) Inventor: Yoshiaki Nakaya, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 16/485,758

(22) PCT Filed: Feb. 6, 2018

(86) PCT No.: PCT/JP2018/004092
§ 371 (c)(1),
(2) Date: Aug. 13, 2019

(87) PCT Pub. No.: WO2018/155176
PCT Pub. Date: Aug. 30, 2018

(65) Prior Publication Data

US 2020/0018458 A1 Jan. 16, 2020

(30) Foreign Application Priority Data

Feb. 24, 2017 (JP) ..... 2017-032916

(51) Int. Cl.
*F21S 45/43* (2018.01)
*F21S 45/47* (2018.01)

(52) U.S. Cl.
CPC ..... *F21S 45/43* (2018.01); *F21S 45/47* (2018.01)

(58) Field of Classification Search
None
See application file for complete search history.

(56) References Cited

U.S. PATENT DOCUMENTS

| | | | | |
|---|---|---|---|---|
| 9,157,598 | B2 * | 10/2015 | Tralli | F21K 9/23 |
| 2010/0020563 | A1 | 1/2010 | Ito et al. | |
| 2010/0270927 | A1 | 10/2010 | Noyori et al. | |
| 2016/0348869 | A1 | 12/2016 | Williams et al. | |

FOREIGN PATENT DOCUMENTS

| | | | |
|---|---|---|---|
| DE | 102007043961 | A1 | 3/2009 |
| JP | 2009-295513 | A | 12/2009 |
| JP | 2010-027583 | A | 2/2010 |
| JP | 2010-254099 | A | 11/2010 |
| JP | 2011-108382 | A | 6/2011 |
| JP | 2014-044900 | A | 3/2014 |
| JP | 2016-192556 | A | 11/2016 |
| JP | 2017-010893 | A | 1/2017 |
| KR | 2015-0106688 | A | 9/2015 |

OTHER PUBLICATIONS

International Search Report issued in PCT/JP2018/004092; dated Apr. 24, 2018.

* cited by examiner

*Primary Examiner* — Vip Patel
(74) *Attorney, Agent, or Firm* — Studebaker & Brackett PC

(57) ABSTRACT

A vehicle lighting fixture includes: a light source; an outer lens disposed in front of the light source; a heat sink thermally connected to the light source; and an air blower having air blowing openings behind the light source. The heat sink includes: a base portion extending outward, relative to the light source, in an intersection direction intersecting with an optical axis of the light source; and a heat dissipation portion extending longitudinally from an outer portion of the base portion in the intersection direction, dissipating heat to the air blown from the air blowing openings, and directing the air to the outer lens.

7 Claims, 8 Drawing Sheets

LIGHTING FIXTURE FOR VEHICLE

TECHNICAL FIELD

The technique disclosed herein relates to a lighting fixture for a vehicle (hereinafter referred to as "vehicle lighting fixture").

BACKGROUND ART

As exemplified in Patent Document 1, vehicle lighting fixtures including a heat sink and an air blower behind a light source have been known.

The vehicle lighting fixtures of this type disclosed in, e.g., Patent Document 1 include the heat sink for dissipating heat from the light source, and cool the heat sink by blowing the air toward the heat sink from the air blower. That is to say, the heat sink and the air blower included in the conventional vehicle lighting fixtures are used exclusively for dissipating heat from the light source, and the dissipated heat is not effectively utilized.

CITATION LIST

Patent Document

PATENT DOCUMENT 1: Japanese Unexamined Patent Publication No. 2010-254099

SUMMARY OF THE INVENTION

Technical Problem

Some vehicle lighting fixtures, such as headlights, are required to defog its outer lens due to, e.g., condensation, and melt snow on its outer lens. To meet such requirements, the vehicle lighting fixtures having a configuration in which an exclusive heater, a thermocouple, and interconnects thereof are separately added have already been put to practical use. However, there is no vehicle lighting fixture that effectively utilizes heat from the light source. Thus, in order to defog the outer lens and melt snow on the outer lens, these known vehicle lighting fixtures are susceptible to improvement.

The technique disclosed herein can efficiently defog an outer lens and efficiently melt snow on the outer lens.

Solution to the Problem

The technique disclosed herein relates to a vehicle lighting fixture including a light source, an outer lens arranged in front of the light source, a heat sink thermally connected to the light source, and an air blower having an air blowing portion behind the light source. The heat sink includes: a base portion extending outward, relative to the light source, in a direction intersecting with an optical axis extending frontward of the light source; and a heat dissipation portion extending longitudinally from an outer portion of the base portion in the intersection direction, and directing the air to the outer lens.

With the above-mentioned configuration, the air is blown from the air blowing portion so as to be directed to the outer lens along the heat dissipation portion extending longitudinally from the outer portion of the base portion in the intersection direction, thereby accelerating heat dissipation by the heat sink and causing the blown air to reach the outer lens while warming the air utilizing the heat dissipation.

Accordingly, use of the heat dissipation of the light source allows for efficiently defogging the outer lens and efficiently melting snow on the outer lens.

The expression "frontward" indicates the irradiation direction of the light source, the expression "backward" indicates the direction opposite to the irradiation direction, and the expression "longitudinal direction" indicates the direction parallel to the optical axis of the light source.

In one aspect, the light source may be provided in front of the base portion, and provided in a center portion of the base portion when viewed from the front.

With the above-mentioned configuration, in comparison with the case in which the light source is provided at a site deviating outward with respect to the center portion of the base portion in the intersection direction, when the base portion transfers heat of the light source outward in the intersection direction, it can transfer the heat uniformly in the peripheral direction of the base portion to achieve more efficient heat dissipation.

In another aspect, the heat dissipation portion may extend to a position at which a front end of the heat dissipation portion is located frontward of the light source.

With the above-mentioned configuration, heat storage performance and heat dissipation performance of the heat transferred from the base portion can be enhanced for the length of the heat dissipation portion extending frontward relative to the light source, thereby enhancing cooling performance of the light source and enhancing warming ability of the air blown from the air blowing portion.

In addition, for the length of the heat dissipation portion extending frontward relative to the light source, a limited space in a lighting chamber, that is, the longitudinal length between the outer lens and the light source can be effectively utilized to achieve reduction in size, and the heat dissipation performance can be enhanced with the increased surface area of the heat dissipation portion.

That is to say, while an interval between the heat source and the outer lens disposed in front thereof is normally set in consideration of, e.g., an optical viewpoint, a space in front of the light source that corresponds to the interval can be effectively utilized by causing the heat dissipation portion to extend forward relative to the light source.

In still another aspect, a back portion, of the heat dissipation portion, behind the base portion may be longer than a front portion, of the heat dissipation portion, in front of the base portion.

With the above-mentioned configuration, it is preferable that the heat dissipation portion extend longitudinally to be as long as possible from the viewpoint of the heat dissipation performance of the heat sink. The extending length of the heat dissipation portion in the frontward direction is however limited in consideration of a layout relation with the outer lens disposed in front of the base portion. On the other hand, the heat dissipation portion can extend backward without such limitation, thereby further enhancing the heat dissipation performance.

In still another aspect, the heat dissipation portion may be comprised of: a heat dissipation main body provided in a peripheral direction with the light source as a center portion; and a plurality of heat dissipation fins standing outward in the intersection direction from the heat dissipation main body, extending longitudinally, and disposed in the peripheral direction. An air guiding portion may be defined by the heat dissipation fins to direct blown air to the outer lens.

With the above-mentioned configuration, the surface area of the heat dissipation portion is increased by providing the heat dissipation fins on the heat dissipation portion, thereby enhancing the heat dissipation performance thereof.

The air blown from the air blowing portion can be guided along the air guiding portion while being guided by the heat dissipation fins, so that the blown air can be efficiently directed to the outer lens by the heat dissipation portion.

In still another aspect, the heat dissipation fins may be formed to have a projecting length larger than a thickness of the base portion.

With the above-mentioned configuration, the heat dissipation fins are provided with the heat dissipation portion. The surface area of the heat dissipation portion can therefore be significantly increased by increasing the projecting lengths of the heat dissipation fins, thereby enhancing the heat dissipation performance.

The heat dissipation fins are formed to have a projecting length larger than the thickness of the base portion, thereby enhancing, in the air guiding portion, an air guiding function of the air blown from the air blowing portion by the heat dissipation fins.

In still another aspect, the air blower may be configured to eject the air from the air blowing portion provided at a site corresponding to the air guiding portion of the heat dissipation portion in the peripheral direction.

With the above-mentioned configuration, the air ejected from the air blowing portion can be efficiently blown along the air guiding portion, thereby enhancing the airflow directivity to the outer lens.

Advantages of the Invention

The technique disclosed herein can efficiently defog an outer lens and efficiently melt snow on the outer lens using heat dissipation of the light source.

DESCRIPTION OF EMBODIMENTS

Hereinafter, an embodiment of a vehicle lighting fixture disclosed herein will be described in detail with reference to the drawings. The vehicle lighting fixture, which will be described below, is one example.

Figure 1:
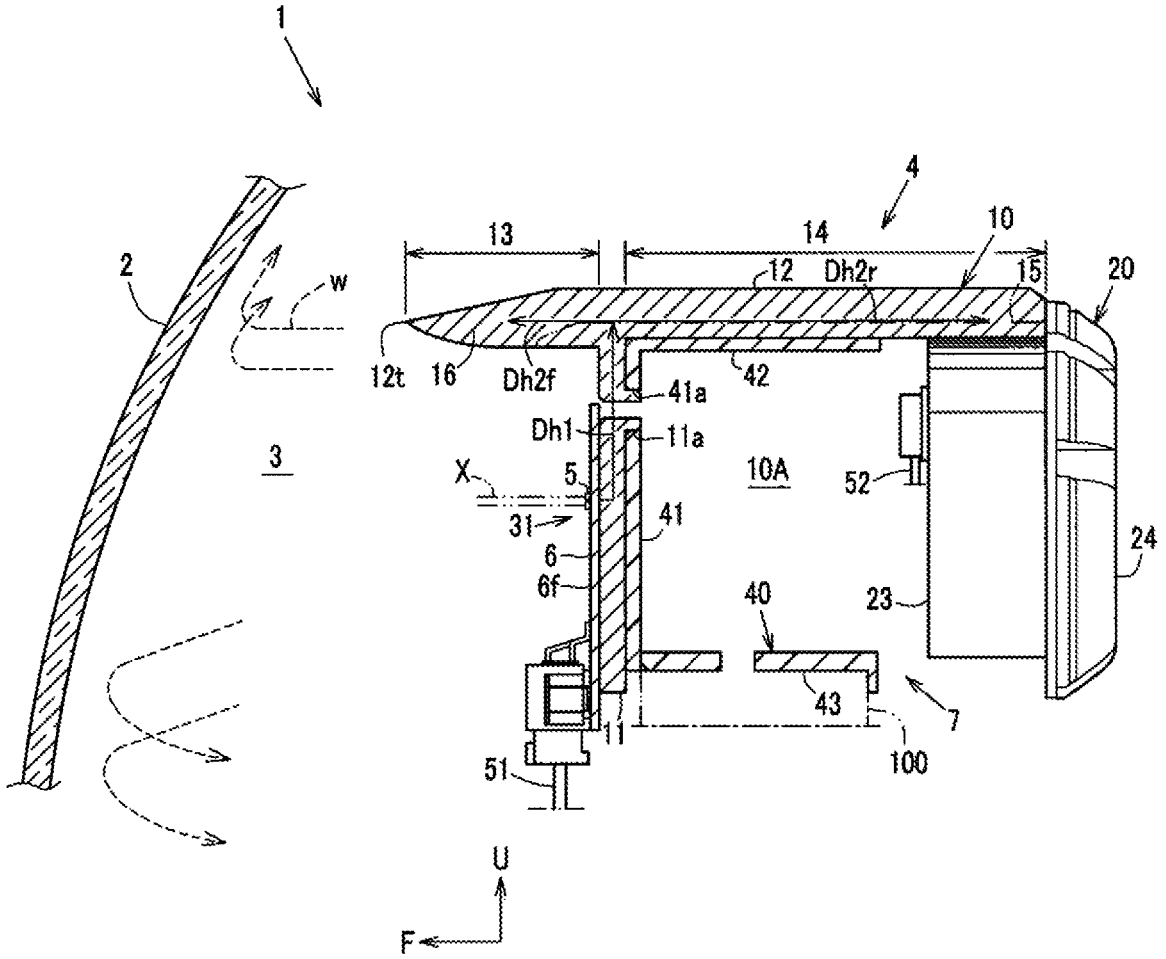
FIG. 1 is a vertical cross-sectional view of a vehicle lighting fixture according to an embodiment.
Figure 2:
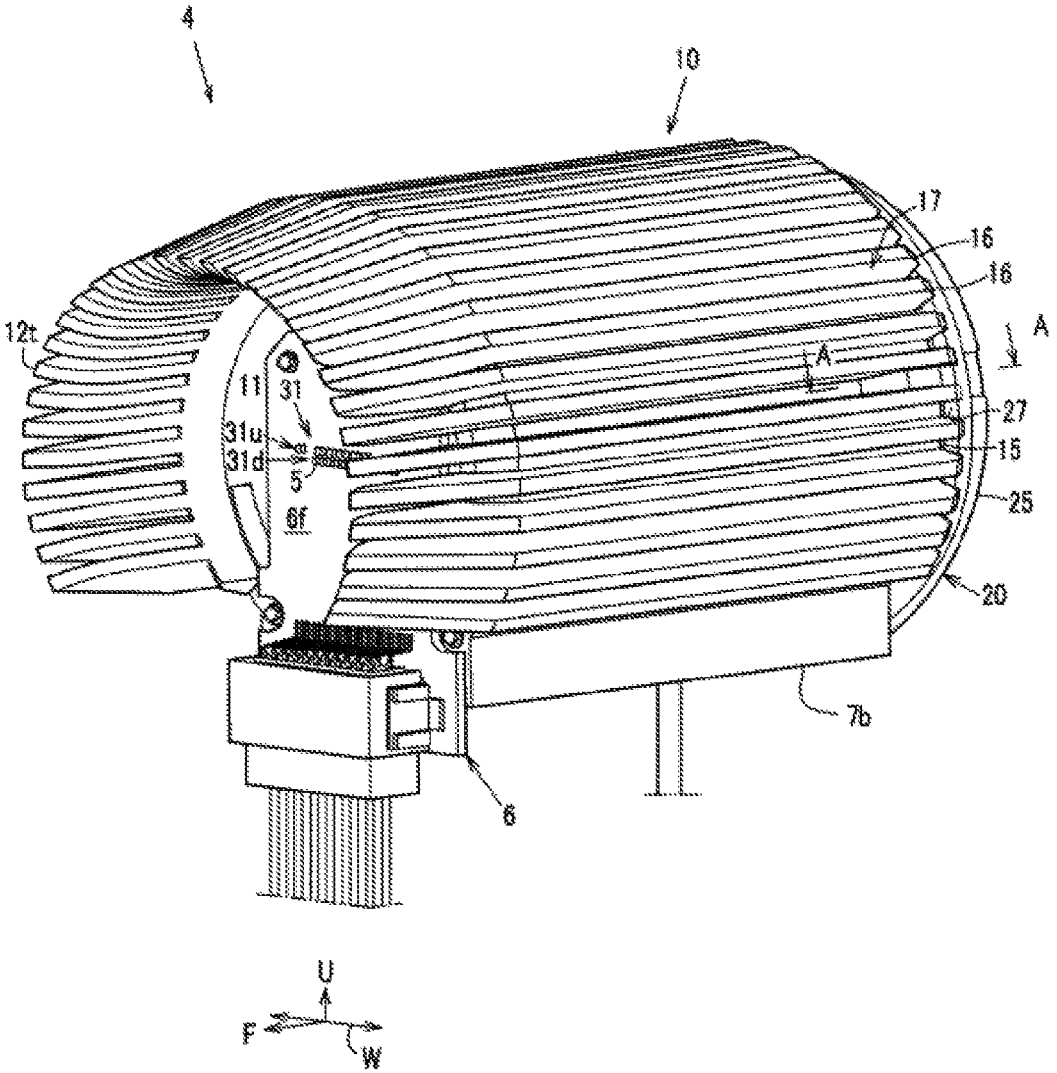
FIG. 2 is a perspective view of a main part of the vehicle lighting fixture according to the embodiment.
Figure 3:
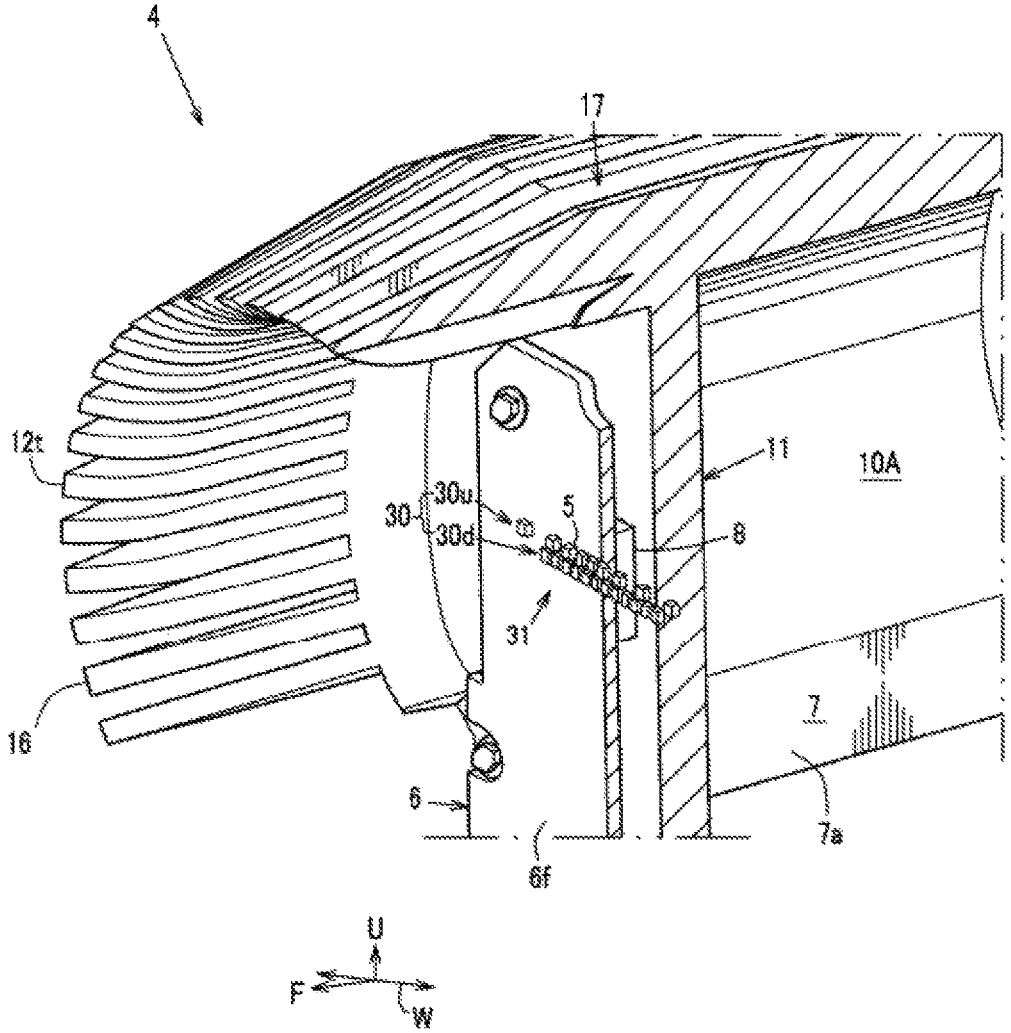
FIG. 3 is a perspective cross sectional view illustrating the main part of the vehicle lighting fixture according to the embodiment.
Figure 4:
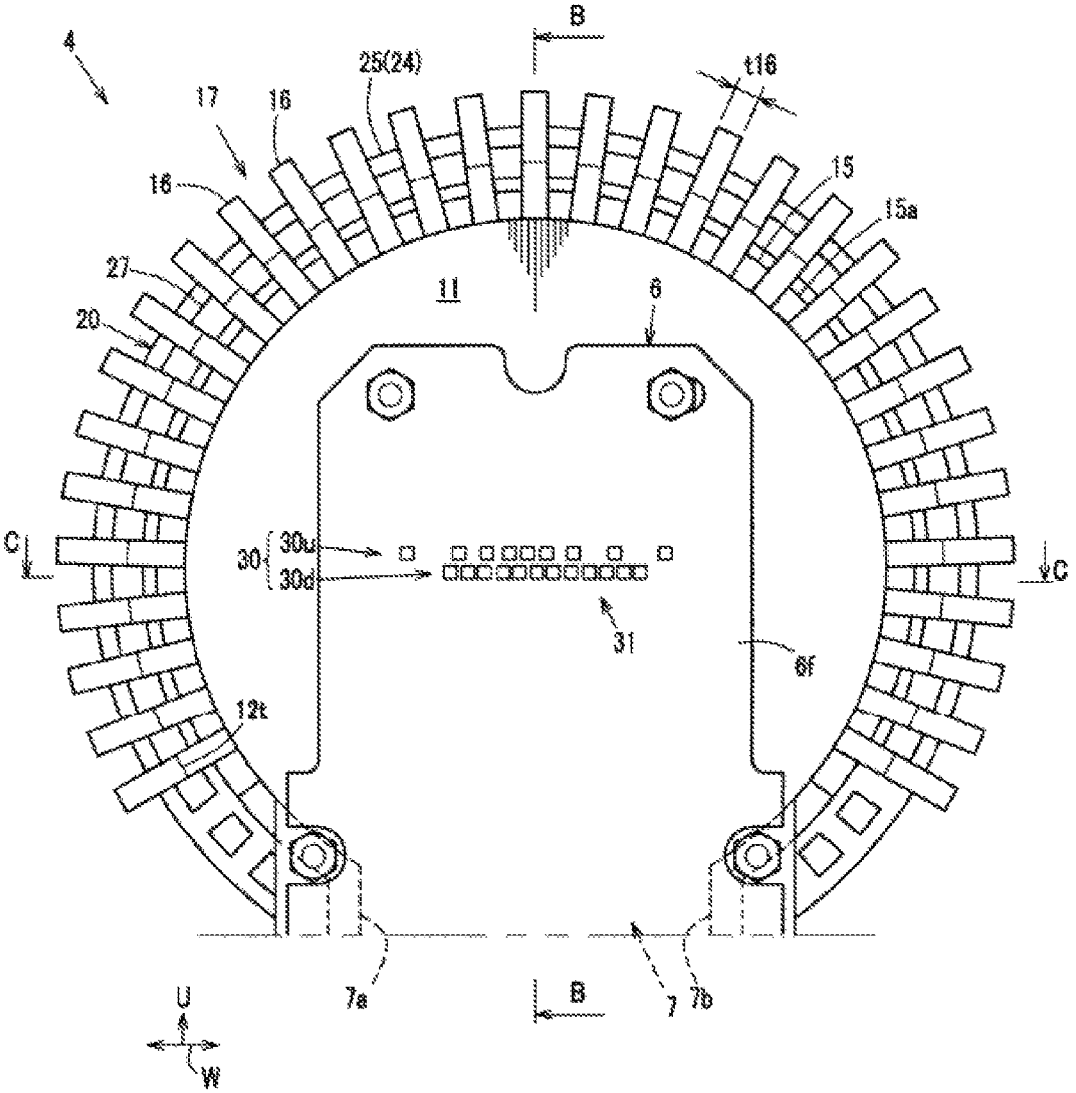
FIG. 4 is a front view of the main part of the vehicle lighting fixture according to the embodiment.
Figure 5:
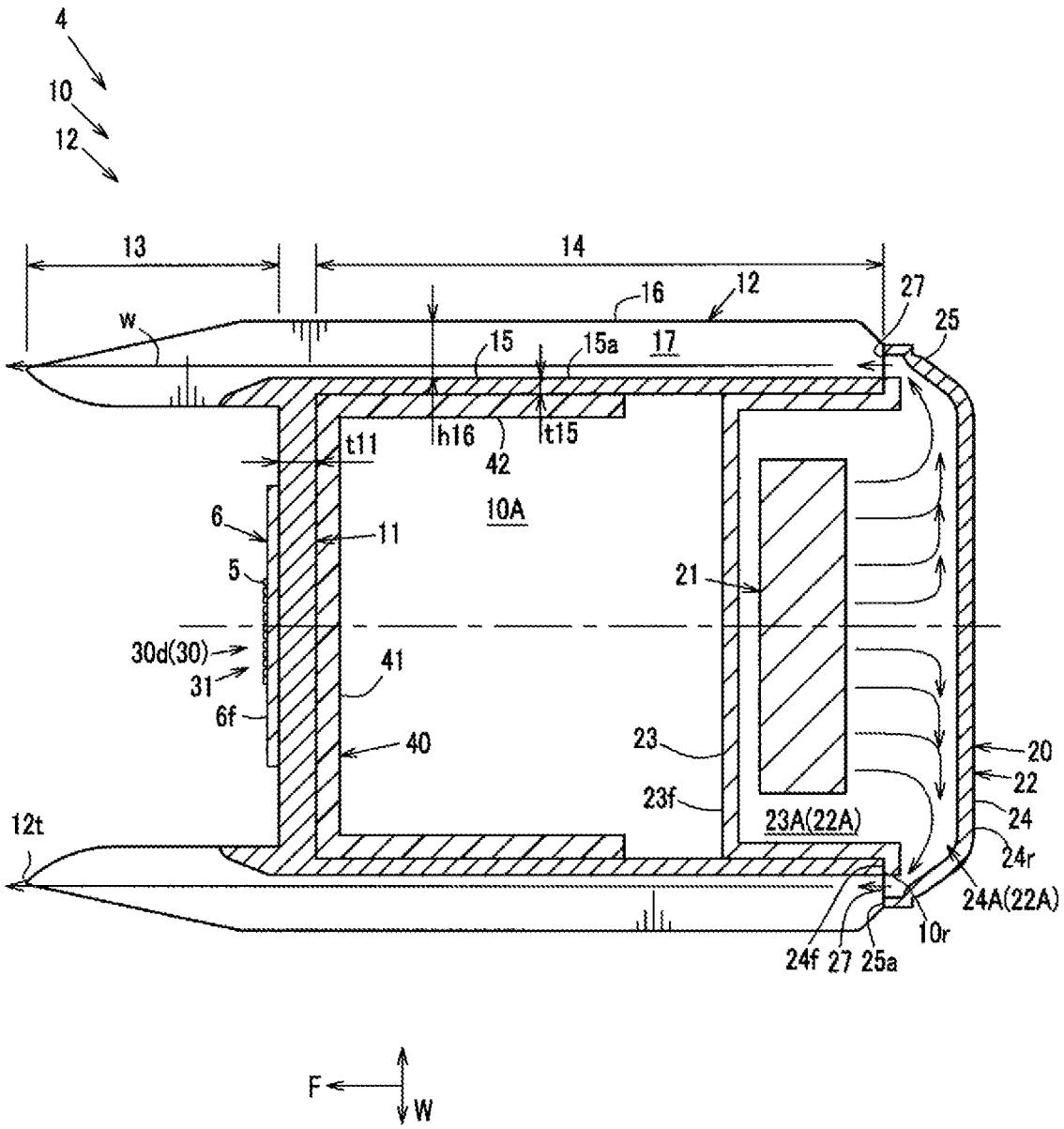
FIG. 5 is a cross-sectional view taken along line C-C of FIG. 4.
Figure 6A:
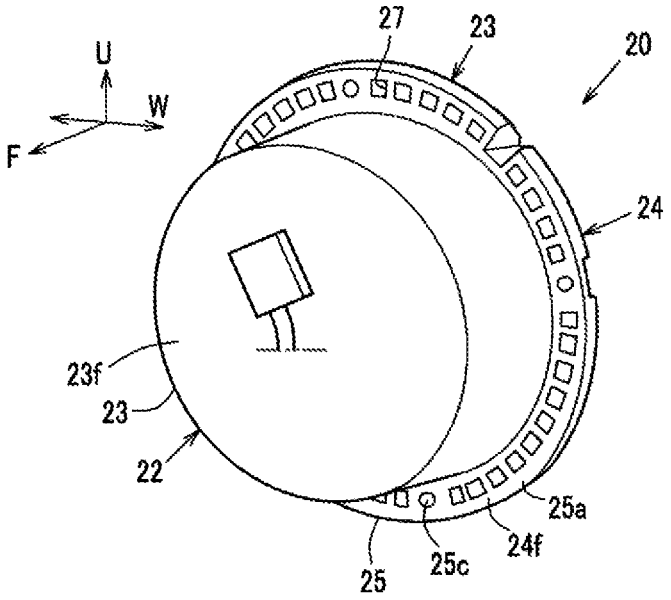
FIG. 6A is an outer appearance view illustrating a main part of an air blower.
Figure 6B:
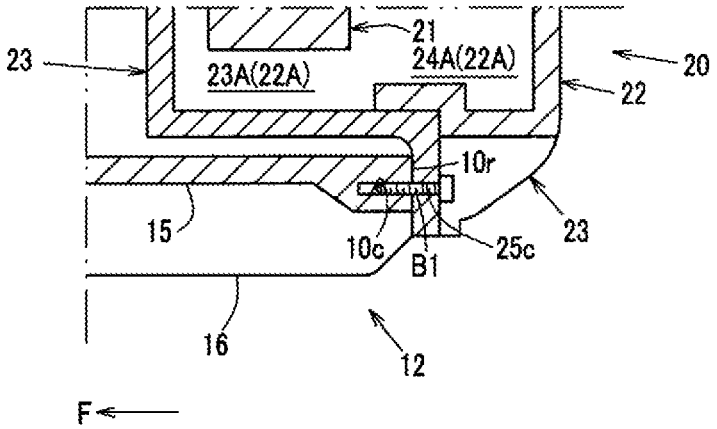
FIG. 6B is an enlarged cross-sectional view along line A-A of FIG. 2.

FIG. 1 is a partial vertical cross-sectional view of a center portion of the vehicle lighting fixture according to the embodiment in a vehicle width direction, and is a cross-sectional view taken along line B-B in FIG. 4. FIG. 2 is a perspective view of a main part of the vehicle lighting fixture according to the embodiment. FIG. 3 is a perspective view of a vertical cross section of the center portion of the vehicle lighting fixture according to the embodiment in the vehicle width direction, and is a perspective cross-sectional view taken along line along arrow B-B in FIG. 4. FIG. 4 is a front view of the main part of the vehicle lighting fixture according to the embodiment. FIG. 5 is a cross-sectional view taken along line C-C of FIG. 4. FIG. 6A is an outer appearance view illustrating a main part of an air blower. FIG. 6B is an enlarged cross-sectional view along line A-A of FIG. 2.

Vehicle lighting fixtures 1, 1 according to the embodiment are used as fog lamps arranged at front right and left positions of the vehicle, and have the same basic configuration on the right and left sides. Therefore, only one vehicle lighting fixture 1 will be described hereinafter. In the drawings, an arrow F indicates a vehicle frontward direction, an arrow W indicates the vehicle width direction, and an arrow U indicates a vehicle upward direction. In the embodiment, the irradiation direction of light emitting diodes (LEDs), that is a light source, included in the vehicle lighting fixture 1 is consistent with the frontward direction of the vehicle.

The vehicle lighting fixture 1 according to the embodiment includes a recessed lamp housing (not illustrated) opening frontward and, as illustrated in FIG. 1, a transparent outer lens 2 covering the front opening thereof. In the vehicle lighting fixture 1, an internal space is defined as a lighting chamber 3 by the lamp housing and the outer lens 2.

As illustrated in FIG. 1, a lamp unit 4 is disposed in the lighting chamber 3. As illustrated in FIGS. 2 and 3, the lamp unit 4 includes LEDs 5 serving as the light source, a flat plate-like substrate 6 made of copper on which the LEDs 5 are mounted, a heat sink 10 thermally connected to the LEDs 5, and an air blower 20 having air blowing openings 27 (see FIG. 2) serving as an air blowing portion.

The substrate 6 is disposed so as to be orthogonal to the longitudinal direction (that is, so as to face the outer lens 2). The LEDs 5 are provided on a center portion of a front surface 6*f* of the substrate 6 in front view (that is, when seen from the outer lens 2) in order to enlarge an irradiation range, as illustrated in FIG. 4. The LEDs 5 are mounted such that all of them are directed to the front (that is, optical axes X of the LEDs 5 are consistent with the longitudinal direction).

The LEDs 5 are arranged in rows extending in the vehicle width direction to constitute light source arrangement portions 30 (30*u*, 30*d*). The number and arrangement of the LEDs 5 are appropriately set in accordance with, e.g., luminance required as the vehicle lighting fixture 1, and the two light source arrangement portions 30 are mounted on the front surface of the substrate 6 on the upper and lower rows in parallel to each other in this example. The two light source arrangement portions 30 form an LED module 31. Nine LEDs 5 are arranged in the upper light source arrangement portion 30*u* in a predetermined array pattern, and twelve LEDs 5 are arranged in the lower light source arrangement portion 30*d* in a predetermined array pattern.

The heat sink 10 is made of aluminum or an aluminum alloy, and is disposed behind the LED module 31. The heat sink 10 is comprised of a base portion 11 and a heat dissipation portion 12 which are integrally formed with each other. The base portion 11 extends radially outward relative to the LED module 31. The heat dissipation portion 12 is disposed at a radially outward portion of the base portion 11

(that is, outward portion in the direction intersecting with the optical axes X). The substrate 6 is mounted on the base portion 11 by, e.g., being bonded to the front surface of the base portion 11 using, e.g., Si-based conductive grease 8 as an adhesive having heat conductivity (see FIG. 3). The base portion 11 thereby exchanges heat with the substrate 6 to dissipate heat of the LEDs 5 and conduct the heat to the heat dissipation portion 12.

The air blower 20 is provided behind the base portion 11, and the air blowing openings 27 are provided behind the heat dissipation portion 12.

The heat dissipation portion 12 is provided at the radially outward portion, of the base portion 11, radially outward of at least the LED module 31 over the entire periphery of the heat sink 10 except a lower portion of the heat sink 10.

The heat dissipation portion 12 extending substantially longitudinally and cylindrically shaped is formed into a substantially C shape when viewed from the front such that a lower portion of the heat dissipation portion 12 opens downward (see FIG. 4). A lower opening 7, of the heat dissipation portion 12, that opens downward is formed over the entire length of the heat dissipation portion 12 in the longitudinal direction. Both edge portions 7*a* and 7*b* of the lower opening 7 in the peripheral direction project downward. That is to say, in the peripheral direction, one opening edge portion 7*a* projecting downward is formed on one edge portion of the heat dissipation portion 12 and the other opening edge portion 7*b* is formed on the other edge portion thereof (see FIG. 4).

As illustrated in FIGS. 1 and 2, the heat dissipation portion 12 is comprised of a frontward-extending portion 13 extending frontward relative to the base portion 11 to the front of the outer lens 2 and a backward-extending portion 14 extending backward. The frontward-extending portion 13 extends such that a front end 12*t* thereof is located frontward of the LEDs 5. The frontward-extending portion 13 is thereby disposed so as to surround the substrate 6 (LED module 31) other than a lower portion thereof in the peripheral direction.

The backward-extending portion 14 extends with a larger longitudinal length than that of the frontward-extending portion 13. The backward-extending portion 14 and the base portion 11 define a heat sink internal space 10A opening backward and downward on the radially inner side of the backward-extending portion 14 and behind the base portion 11.

In other words for the heat dissipation portion 12, as illustrated in FIGS. 2 and 5, the heat dissipation portion 12 is comprised of a heat dissipation main body 15 and a plurality of heat dissipation fins 16 which are integrally formed with each other. The heat dissipation main body 15 is located on the radially inner side. The plurality of heat dissipation fins 16 stand radially outward from the heat dissipation main body 15.

The heat dissipation main body 15 is continuously formed with a constant thickness (plate thickness) in the peripheral direction of the heat dissipation portion 12 (see FIG. 5). The heat dissipation main body 15 is formed continuously in the longitudinal direction at sites of the heat dissipation portion 12 in the longitudinal direction that correspond to a back portion of the frontward-extending portion 13, the base portion 11, and the backward-extending portion 14.

The heat dissipation fins 16 continuously extend linearly in the longitudinal direction on the outer peripheral surface of the heat dissipation main body 15, and are arranged at an equal pitch in the peripheral direction.

As illustrated in FIGS. 1 and 3, the heat dissipation fins 16 extend not only to a site of the frontward-extending portion 13 that corresponds to the heat dissipation main body 15 provided in the back portion thereof in the longitudinal direction but also to the front end 12*t* of the frontward-extending portion 13 from the site that corresponds to the heat dissipation main body 15. That is to say, the heat dissipation fins 16 are continuously formed with a constant plate thickness (t16) over the entire length of the heat dissipation portion 12 in the longitudinal direction.

Therefore, the heat dissipation fins 16 provided in the frontward-extending portion 13 in front of the heat dissipation main body 15 radially communicate with one another because the heat dissipation main body 15 is not provided in the frontward-extending portion 13 (see FIGS. 3 and 5).

The thickness of the heat dissipation fins 16 provided in the frontward-extending portion 13 in the radial direction are formed to be gradually decreased in thickness so as to be tapered frontward.

As illustrated in FIG. 5, the heat dissipation fins 16 provided in the backward-extending portion 14 are formed to have a larger projecting length (length in the radial direction) (h16) than the thickness (plate thickness) (t11) of the base portion 11. As illustrated in FIGS. 4 and 5, the base portion 11 is formed to be thicker than each of the heat dissipation main body 15 and the heat dissipation fins 16 (t11>t15, t16), but the thickness (t11) of the base portion 11 is equal to or less than twice each of the plate thickness (t15) of the heat dissipation main body 15 and the plate thickness (t16) of the heat dissipation fins 16.

The heat dissipation portion 12 extends in the longitudinal direction so as to dissipate heat to the air blown from the air blowing openings 27 and direct the air to the outer lens 2.

That is to say, as illustrated in FIGS. 2 to 5, air guiding paths 17 extending linearly in the longitudinal direction are formed between the heat dissipation fins 16, 16 adjacent to each other in the peripheral direction of the heat dissipation portion 12 from the front end 12*t* to the back end. The air guiding paths 17 are flow paths having both side walls formed by the adjacent heat dissipation fins 16 so as to direct the air ejected from the air blowing openings 27, which will be described later, toward the outer lens 2 on the front side.

The air guiding paths 17 are formed, at the site of the heat dissipation portion 12 with the heat dissipation main body 15 in the longitudinal direction, by the heat dissipation fins 16, 16 adjacent to each other in the peripheral direction and a radial outer surface 15*a* of the heat dissipation main body 15 between the heat dissipation fins 16, so as to have recess shapes recessed radially inward relative to the front ends of the heat dissipation fins 16 when viewed from the direction orthogonal to the longitudinal direction.

As illustrated in FIGS. 1, 2, and 5, the air blower 20 is mounted on the heat sink 10 in a state of being fitted into the heat sink internal space 10A from a back opening of the heat sink internal space 10A. The air blower 20 is comprised of, as illustrated in FIG. 5, a piezoelectric fan unit 21 and a casing 22 accommodating therein the piezoelectric fan unit 21.

The casing 22 is comprised of a housing 23 and a back cover 24. The housing 23 is fitted into the heat sink internal space 10A and is formed into a bottomed cylindrical shape having a back-opening internal space 23A with a closed front surface 23*f*.

The back cover 24 is formed into a bottomed cylindrical shape having a front-opening internal space 24A with a closed back surface 24*r*, the shape being shallower than that of the housing 23. An opening is formed in a center portion of the front surface 24*f* of the back cover 24. The internal space 23A of the housing 23 and the internal space 24A of the back cover 24 communicate with each other in the longitudinal direction, and constitute an internal space 22A of the casing 22.

An outer peripheral portion of the back cover 24 is provided with a flange portion 25 formed to project radially outward relative to the outer diameter of the housing 23 entirely in the peripheral direction so as to be engaged, from the back side, with a back end surface 10*r* of the heat sink 10.

As illustrated in FIGS. 5 and 6A, an annular front surface 25*a* of the flange portion 25 is formed by a radial side portion relative to the opening provided in the center portion of the front surface 24*f* of the back cover 24. The air blowing openings 27 opening backward so as to allow the internal space 22A of the casing 22 and the outside of the casing 22 to communicate with each other are arranged in the peripheral direction in the front surface 25*a* of the flange portion 25. As illustrated in FIGS. 2, 4, and 5, the air blowing openings 27 are provided at sites corresponding to the air guiding paths 17 (that is, sites corresponding to portions between the adjacent heat dissipation fins 16, 16) in the peripheral direction of the heat dissipation portion 12, and the air blown from the piezoelectric fan unit 21 arranged in the casing 22 is ejected from the air blowing openings 27.

As illustrated in FIGS. 6A and 6B, a bolt insertion hole 25*c* is formed at a predetermined site of the flange portion 25 of the back cover 24 in the peripheral direction, and a bolt insertion hole 10*c* is formed also at a site of the back end surface 10*r* of the heat sink 10 that corresponds to the bolt insertion hole 25*c* in the peripheral direction. The air blower 20 is mounted on the heat sink 10 using, e.g., a bolt B1 in a state in which the flange portion 25 is engaged with the back end surface 10*r* of the heat sink 10.

The piezoelectric fan unit 21 is a well-known fan generating the air using a reverse voltage effect of a piezoelectric element, and includes the piezoelectric element, a blade-like air blowing plate connected to the piezoelectric element in a cantilever manner, and an AC voltage application unit applying an AC voltage to the piezoelectric element to excite the air blowing plate and cause the front end (free end) of the air blowing plate to vibrate in the plate thickness direction although they are not illustrated in the drawings. In the embodiment, the piezoelectric fan unit 21 is installed in the internal space 22A of the casing 22 so as to generate the air backward by vibration of the air blowing plate.

The air blower 20 is thereby configured such that, in the casing 22, the air blown from the piezoelectric fan unit 21 once hits the back surface 24*r* of the back cover 24, and then, flows so as to come around radially outward (toward the flange portion 25) to be ejected from the air blowing openings 27.

As illustrated in FIG. 1, the above-mentioned lamp unit 4 is mounted on a lamp unit base portion 100 provided at the bottom of the lamp housing 23 with an inner bracket 40 as a component connecting member interposed therebetween.

A reference character 51 in FIG. 1 is a power source cord supplying a current to the LEDs 5 from a power source such as a battery, a control cord for transmitting a control signal of a control circuit controlling ON/OFF of lighting, or the like. A reference character 52 in FIG. 1 is a power source cord for supplying a current to the air blower 20 from the power source such as the battery, a control cord for transmitting a control signal of a control circuit controlling the piezoelectric fan unit 21, or the like.

As illustrated in FIGS. 1 and 5 (not illustrated in FIG. 3), the inner bracket 40 is formed into a recess shape so as to surround the heat sink internal space 10A and open backward. Specifically, the inner bracket 40 is comprised of a plate-like bracket front wall portion 41, a bracket peripheral wall portion 42, and a plate-like bracket base portion 43 which are integrally formed with each other. The plate-like bracket front wall portion 41 is disposed at a site corresponding to a front surface portion of the heat sink internal space 10A. The bracket peripheral wall portion 42 is disposed on the peripheral surface of the heat sink internal space 10A other than the lower portion. The plate-like bracket base portion 43 is disposed so as to cover the lower opening 7.

The bracket front wall portion 41 extends vertically from a front portion of the lower opening 7 to be integrally connected to the front end of the bracket peripheral wall portion 42. An engagement projection 11*a* is integrally formed with the base portion 11 to project backward on an upper portion of the base portion 11 above the LED module 31.

An engagement hole 41*a* that is engaged with the engagement projection 11*a* is formed in the bracket front wall portion 41 in a penetrating manner at a site corresponding to the engagement projection.

The bracket front wall portion 41 is arranged so as to abut against the back surface of the base portion 11 in a state in which the engagement projection 11*a* of the base portion 11 is engaged with the engagement hole 41*a* of the bracket front wall portion 41.

As illustrated in FIG. 5, the bracket peripheral wall portion 42 is arranged so as to abut against the inner peripheral surface of the heat dissipation main body 15 on the backward-extending portion 14 such that it supports the heat dissipation portion 12 from the radially inner side.

The bracket base portion 43 is formed into a plate shape extending backward from the lower end of the bracket front wall portion 41, and is mounted using, e.g., a bolt in a state of being installed on the lamp unit base portion 100 (see FIG. 1). The lamp unit base portion 100 is a member provided at the bottom of the lamp housing 23, and included in a lighting fixture main body member (not illustrated).

The heat sink 10 is thus mounted on the lamp unit base portion 100 with the inner bracket 40 interposed therebetween, the LEDs 5 and the substrate 6 are mounted on the base portion 11, and the air blower 20 is mounted on the heat dissipation portion 12. The LEDs 5, the substrate 6, and the air blower 20 are therefore also mounted on the lamp unit base portion 100 with the heat sink 10 and the inner bracket 40 interposed therebetween.

The air blower 20 is not limited to be mounted on the inner bracket 40 with the heat sink 10 interposed therebetween as described above, and may employ a configuration of being mounted directly on the inner bracket 40 with no heat sink 10 interposed therebetween or a configuration including both of them, that is, the configuration including a mounting portion on the heat sink 10 and a mounting portion on the inner bracket 40.

The above-mentioned vehicle lighting fixture 1 in the embodiment includes the LEDs 5 as the light source, the outer lens 2 disposed in front of the LEDs 5, the heat sink 10 thermally connected to the LEDs 5, and the air blower 20 having the air blowing openings 27 behind the LEDs 5. The heat sink 10 includes: the base portion 11 extending outward, relative to the LEDs 5, in the direction intersecting with the optical axes X of the LEDs 5, that is, extending radially outward; and the heat dissipation portion 12 extending longitudinally from the radially outer portion of the base portion 11, dissipating heat to the air blown from the air blowing openings 27, and directing the air to the outer lens 2.

According to the above configuration, use of the heat dissipation of the light source allows for efficiently defogging the outer lens 2 and efficiently melting snow on the outer lens 2.

Figure 7:
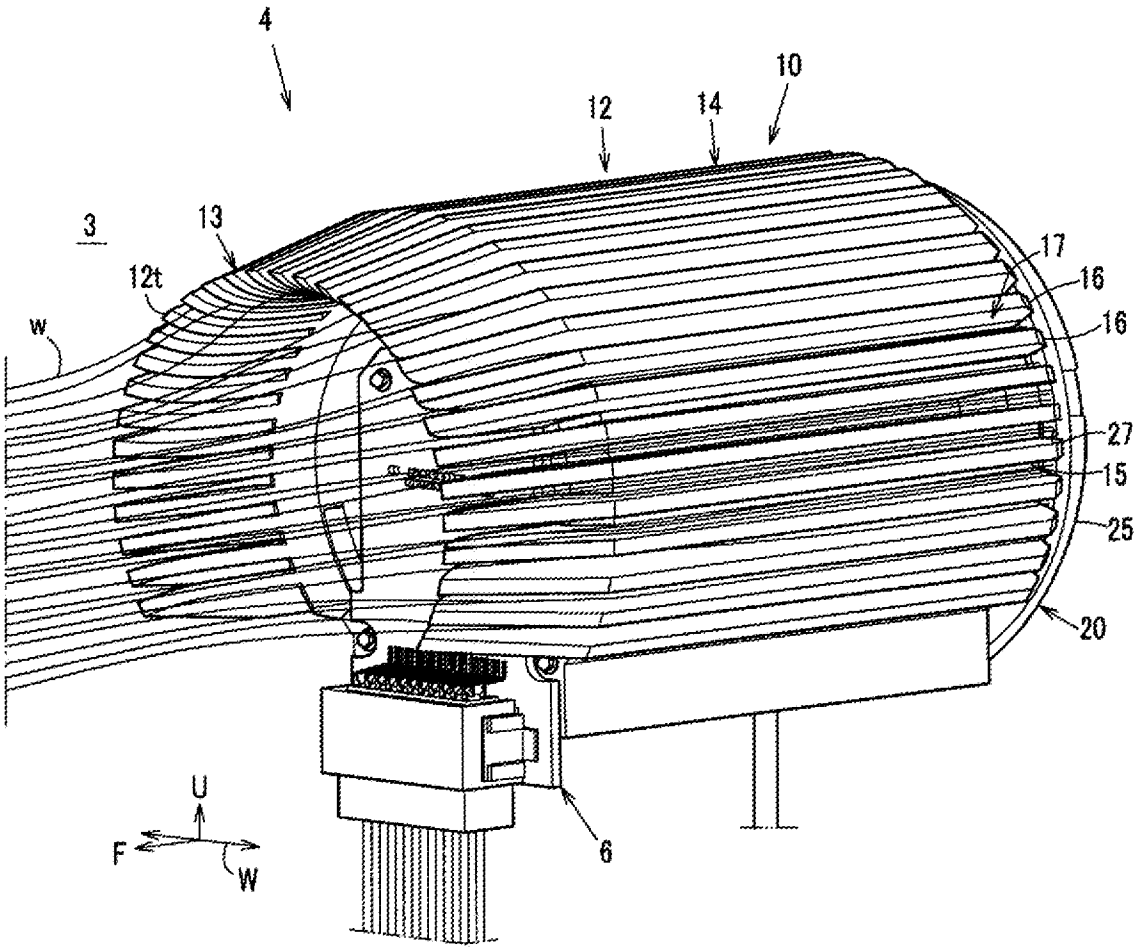
FIG. 7 is an analysis view visualizing the air flowing through a heat sink in the embodiment.

That is to say, in the conventional configuration, for example, the air blower is arranged behind the heat sink, and the air is blown toward the heat sink from the air blower. Thus, the air blown from the air blower is blocked by the heat sink, and has difficulty in reaching the outer lens 2. By contrast, in the embodiment, like flow of the air w in FIGS. 1, 5, and 7, the air is blown from the air blowing openings 27 so as to be directed to the outer lens 2 on the front portion along the heat dissipation portion 12 extending longitudinally, from the radially outer portion of the base portion 11. With this configuration, the heat dissipation by the heat sink 10 is accelerated, and the blown air is caused to reach the outer lens 2 while being warmed using the heat dissipation. This can efficiently defog the outer lens 2 and efficiently melt snow on the outer lens 2.

The substrate 6 also dissipates heat with the acceleration of the heat dissipation of the heat sink 10, and eventually, a cooling effect of the LEDs 5 can be enhanced.

Figure 8:
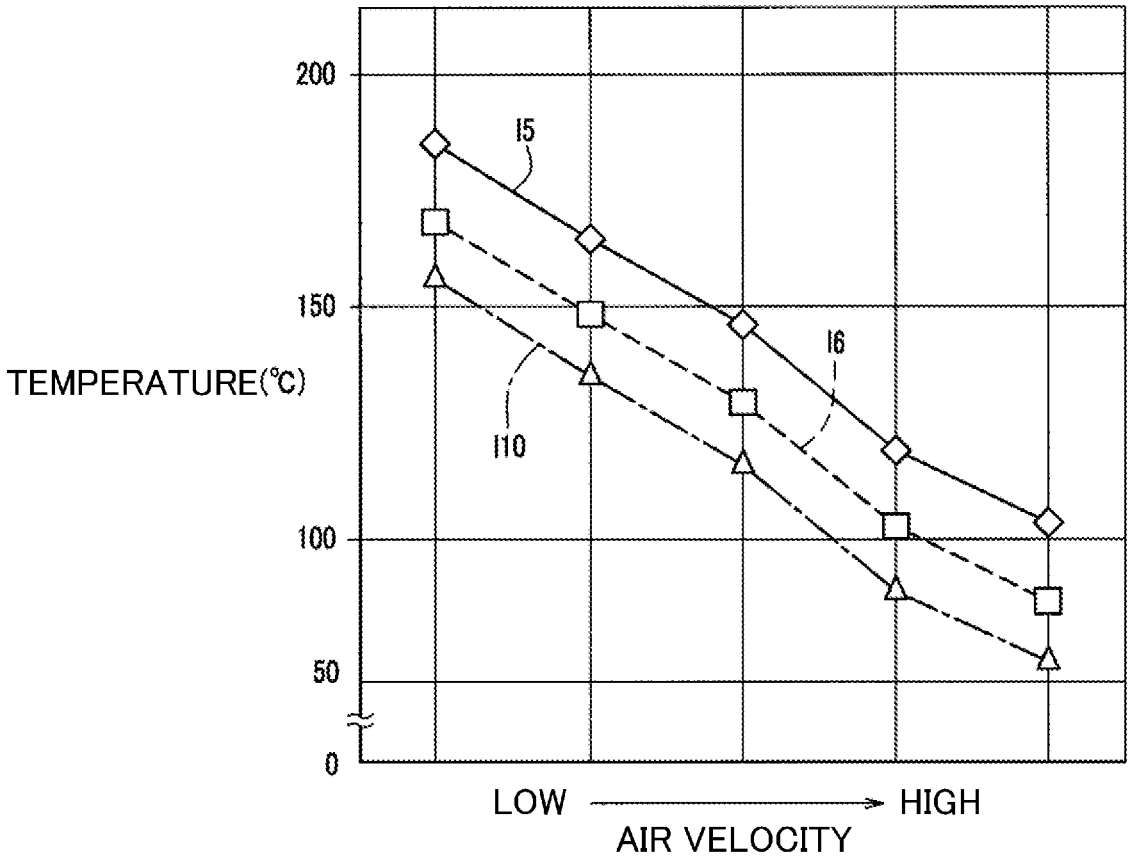
FIG. 8 is a graph illustrating temperature changes of an LED, a substrate back surface, and the heat sink in accordance with the velocity of the air.

FIG. 8 illustrates temperature changes at sites of the LEDs 5, the substrate 6, and the heat sink 10 in accordance with the velocity of the air that is ejected from the air blowing openings 27. A wave form 15 indicated by a solid curve in FIG. 5 indicates the temperature change on the LEDs 5, a wave form 16 indicated by a broken curve indicates the temperature change on the back surface of the substrate 6, and a wave form 110 indicated by a dashed-dotted curve indicates the temperature change on the base portion 11 of the heat sink 10 in accordance with the velocity of the air.

As illustrated in FIG. 8, the LEDs 5 can be reliably cooled together with the substrate 6 and the heat sink 10 in accordance with increase in the velocity of the air blown from the air blowing openings 27.

The base portion 11 extends radially outward relative to the LEDs 5. The heat of the LEDs 5 can therefore be further transferred to a radially outer portion of the base portion 11, and be further transferred to the heat dissipation portion 12 through the base portion 11 (see an arrow Dh1 in FIG. 1). As a result, the heat of the LEDs 5 can be diffused and dissipated to a wide range without filling of the heat in a portion just behind the LEDs 5.

The base portion 11 extends radially outward relative to the LEDs 5. The heat dissipation effect of the LEDs 5 can therefore be obtained while substantially preventing an increase in the plate thickness (t11) (thickness in the longitudinal direction) of the base portion 11 as far as possible. Accordingly, this can substantially prevent an increase in the weight of the heat sink 10 and enhance productivity.

In the above-mentioned configuration, a space (heat sink internal space 10A) is easily ensured behind the base portion 11. The air blower 20 can therefore be arranged in the heat sink internal space 10A while ensuring the heat dissipation effect. Accordingly, both of the size reduction and the heat dissipation effect can be achieved as the overall vehicle lighting fixture 1.

In one aspect, the LEDs 5 are provided in front of the base portion 11, and provided in the center portion of the base portion 11 when viewed from the front (see FIG. 4).

With the above-mentioned configuration, in comparison with the case in which the LEDs 5 are provided at a site deviating radially outward relative to the center portion of the base portion 11, when the heat of the LEDs 5 is transferred to the radially outer portion of the base portion 11, it can be transferred uniformly in the peripheral direction of the base portion 11 to achieve more efficient heat dissipation.

In another aspect, the heat dissipation portion 12 extends to a position at which the front end 12*t* thereof is located frontward of the LEDs 5.

With the above-mentioned configuration, heat storage performance and heat dissipation performance of the heat transferred from the base portion 11 can be enhanced for the length of the heat dissipation portion 12 extending frontward relative to the LEDs 5 (see an arrow Dh2*f* in FIG. 1), thereby enhancing the cooling performance of the LEDs 5 and enhancing warming ability of the air blown from the air blowing openings 27.

In addition, for the length of the heat dissipation portion 12 extending frontward relative to the LEDs 5, a limited space in the lighting chamber 3, that is, the longitudinal length between the outer lens 2 and the LEDs 5 can be effectively utilized to achieve reduction in size, and the heat dissipation performance can be enhanced with the increased surface area of the heat dissipation portion 12.

That is to say, while an interval between the LEDs 5 as the heat source and the outer lens 2 disposed in front thereof is necessarily set in consideration of, e.g., an optical viewpoint, the space in front of the LEDs 5 that corresponds to the interval can be effectively utilized by causing the heat dissipation portion 12 to extend forward relative to the LEDs 5.

In still another aspect, the back portion, of the heat dissipation portion 12, behind the base portion is longer than a front portion, of the heat dissipation portion 12, in front of the base portion 11. That is to say, the longitudinal length of the backward-extending portion 14 is made longer than that of the frontward-extending portion 13 (see FIG. 1).

With the above-mentioned configuration, it is preferable that the heat dissipation portion 12 extend longitudinally to be as long as possible from the viewpoint of the heat dissipation performance of the heat sink 10. The extending length of the heat dissipation portion 12 in the frontward direction is however limited in consideration of a layout relation with the outer lens 2 disposed in front of the base portion 11. On the other hand, the heat dissipation portion 12 can extend backward without such limitation, thereby further enhancing the heat dissipation performance (see an arrow Dh2*r* in FIG. 1).

In still another aspect, the heat dissipation portion 12 is comprised of the heat dissipation main body 15 provided in the peripheral direction thereof, and the heat dissipation fins 16 standing radially outward from the heat dissipation main body 15, extending longitudinally, and disposed in the peripheral direction. The air guiding paths 17 directing the blown air to the outer lens 2 are defined by the heat dissipation fins 16.

With the above-mentioned configuration, the surface area of the heat dissipation portion 12 can be increased by providing the heat dissipation fins 16 on the heat dissipation portion 12, thereby enhancing the heat dissipation performance thereof.

Further, the air guiding paths 17 is defined by the heat dissipation fins 16, and therefore, the air blown from the air blowing openings 27 can be directed to the outer lens 2 along the air guiding paths 17 while being guided by the heat dissipation fins 16. This allows the air warmed by the heat dissipation of the heat sink 10 to be blown to reach the outer lens 2 while accelerating the heat dissipation of the heat sink 10, thereby obtaining the outstanding advantage of efficient defogging and snow melting.

That is to say, provision of the air guiding paths 17 can achieve both of the guide function of guiding the air blown from the air blowing openings 27 so as to direct the air to the outer lens 2 and the warming function (that is, the cooling function of the LEDs 5) of warming the air by the heat dissipation while guiding the air.

In still another aspect, the heat dissipation fins 16 are provided to have the projecting length (h16) larger than the thickness (ill) of the base portion 11 (see FIG. 5).

With the above-mentioned configuration, the heat dissipation fins 16 are formed to have the projecting length larger than the plate thickness of the base portion 11 that is formed to be thick in order to enhance heat absorption performance for the LEDs 5. Therefore, the heat dissipation fins 16 having the sufficient projecting length can therefore be provided to increase the surface area of the heat dissipation portion 12, thereby enhancing the heat dissipation performance.

The heat dissipation fins 16 are provided with the projecting lengths larger than the thickness of the base portion 11, thereby enhancing, in the air guiding paths 17, the air guiding function of the air blown from the air blowing openings 27 by the heat dissipation fins 16.

In still another aspect, the air blower 20 is configured to eject the air from the air blowing openings 27 provided at the sites corresponding to the air guiding paths 17 in the peripheral direction of the heat dissipation portion 12 (see FIGS. 2, 4, and 5).

With the above-mentioned configuration, the air ejected from the air blowing openings 27 can be efficiently blown along the air guiding paths 17, thereby enhancing the airflow directivity to the outer lens 2.

In the above-mentioned configuration, the piezoelectric fan unit 21 is preferably employed as an air blowing source of the air blower 20 as in the embodiment, for example. For example, the piezoelectric fan unit 21 has characteristics that the blown air hardly generates vortex flow and the velocity of the blown air is low but the static pressure (flow rate) thereof is high in comparison with a type of an air blowing source rotating about an axis of a cooling fan including a propeller, or the like. The piezoelectric fan unit 21 can therefore blow the air ejected from the air blowing openings 27 farther along the air guiding paths 17. That is to say, the directivity of the air to the outer lens 2 provided on the front portion can be enhanced by ejecting the air frontward from the air blowing openings 27 provided at the back end of the air guiding paths 17 extending longitudinally.

The technique disclosed herein is not limited to only the configuration in the above-mentioned embodiment, and can be implemented by various embodiments.

In the specification, the expression "frontward" indicates the irradiation direction of the light source, and the expression "behind (backward)" indicates the direction opposite to the irradiation direction of the light source. Although the above-mentioned embodiment has described the example in which the irradiation direction of the LEDs 5 is consistent with the frontward direction of the vehicle and the irradiation direction of the LEDs 5 is consistent with the irradiation direction of the lighting fixture unit, they may not be necessarily consistent with each other.

Specifically, when the vehicle lighting fixture includes a reflector (not illustrated), the expression "frontward" indicates the direction toward the reflector before the light emitted from the LEDs 5 refracts by the reflector and indicates the direction toward the outer lens (outward of the vehicle lighting fixture) after the refraction.

DESCRIPTION OF REFERENCE CHARACTERS

1 Vehicle Lighting Fixture
2 Outer Lens
5 LED (Light Source)
10 Heat Sink
11 Base Portion
12 Heat Dissipation Portion
13 Frontward-extending Portion (in Front of Base Portion)
14 Backward-extending Portion (Behind Base Portion)
15 Heat Dissipation Main Body
16 Heat Dissipation Fin
17 Air Guiding Path (Air Guiding Portion)
20 Air Blower
27 Air Blowing Opening (Air Blowing Portion)
X Optical Axis of Light Source
t11 Thickness of Base Portion
h16 Projecting Length of Heat Dissipation Fin

The invention claimed is:

1. A vehicle lighting fixture comprising: a light source; an outer lens disposed in front of the light source; a heat sink thermally connected to the light source; and an air blower having an air blowing portion behind the light source, wherein the heat sink includes:

a base portion extending radially outward relative to the light source, in a direction intersecting with an optical axis of the light source; and a heat dissipation portion extending from a radially outer portion of the base portion in a direction parallel with the optical axis, dissipating heat to air blown from the air blowing portion, and directing the air to the outer lens.

2. The vehicle lighting fixture of claim 1, wherein the light source is provided in front of the base portion, and provided in a center portion of the base portion when viewed from a front.

3. The vehicle lighting fixture of claim 1, wherein the heat dissipation portion extends to a position at which a front end of the heat dissipation portion is located frontward of the light source.

4. The vehicle lighting fixture of claim 1, wherein a back portion, of the heat dissipation portion, behind the base portion is longer than a front portion, of the heat dissipation portion, in front of the base portion.

5. The vehicle lighting fixture of claim 1, wherein the heat dissipation portion is comprised of: a heat dissipation main body provided in a peripheral direction with the light source as a center portion; and a plurality of heat dissipation fins standing outward in the intersection direction from the heat dissipation main body, extending longitudinally, and disposed in the peripheral direction, and an air guiding portion is defined by the heat dissipation fins to direct blown air to the outer lens.

6. The vehicle lighting fixture of claim 5, wherein the heat dissipation fins are formed to have a projecting length larger than a thickness of the base portion.

7. The vehicle lighting fixture of claim 5, wherein the air blower is configured to eject the air from the air blowing portion provided at a site corresponding to the air guiding portion of the heat dissipation portion in the peripheral direction.

* * * * *